US010876244B2

(12) United States Patent
Tobbe et al.

(10) Patent No.: US 10,876,244 B2
(45) Date of Patent: Dec. 29, 2020

(54) METHOD FOR FORMING A SHIPPING SUPPORT FOR A WASHING MACHINE APPLIANCE

(71) Applicant: Haier US Appliance Solutions, Inc., Wilmington, DE (US)

(72) Inventors: Joseph Duane Tobbe, Taylorsville, KY (US); Scott Jeffrey Kocian, Louisville, KY (US); Richard Michael Thomas, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 195 days.

(21) Appl. No.: 16/037,262

(22) Filed: Jul. 17, 2018

(65) Prior Publication Data

US 2020/0024791 A1 Jan. 23, 2020

(51) Int. Cl.

| | |
|---|---|
| ***D06F 39/00*** | (2020.01) |
| ***B65D 85/68*** | (2006.01) |
| ***B65D 19/00*** | (2006.01) |
| ***B65D 19/44*** | (2006.01) |

(52) U.S. Cl.

CPC ..... *D06F 39/001* (2013.01); *B65D 19/0034* (2013.01); *B65D 19/44* (2013.01); *B65D 85/68* (2013.01); *B65D 2519/00815* (2013.01); *B65D 2581/02* (2013.01)

(58) Field of Classification Search

CPC ... D06F 39/001; B65D 19/0034; B65D 19/44; B65D 2519/00815; B65D 2581/02

USPC ..... 53/396; 206/320; 108/51.3; 410/117, 410/118

See application file for complete search history.

(56) References Cited

U.S. PATENT DOCUMENTS

| | | | | |
|---|---|---|---|---|
| 2,932,438 A * | 4/1960 | Smith | B65D 5/12 206/320 |
| 3,187,887 A * | 6/1965 | Charles | D06F 39/001 206/320 |
| 4,241,892 A | 12/1980 | Morris | |
| 4,266,716 A * | 5/1981 | Austin | B65D 5/3621 229/116 |
| 5,016,853 A * | 5/1991 | Cox | A47G 33/12 248/174 |

(Continued)

FOREIGN PATENT DOCUMENTS

| | | |
|---|---|---|
| CN | 1968858 | 5/2007 |
| CN | 101229867 | 7/2008 |

(Continued)

OTHER PUBLICATIONS

International Search Report, PCT Application No. PCT/CN2019/095865, dated Sep. 27, 2019, 2 pages.

*Primary Examiner* — Dariush Seif
(74) *Attorney, Agent, or Firm* — Dority & Manning, P.A.

(57) ABSTRACT

A method for forming a shipping support for a washing machine appliance includes attaching an elongated post to a corrugated sheet. The elongated post is oriented perpendicular to flutes of the corrugated sheet when the elongated post is attached to the corrugated sheet. The method also includes attaching the corrugated sheet to a frame. The frame has a truncated pyramid base at a center of the frame. The frame has a truncated pyramid base is formed with a plurality of supports attached to a plurality of flaps of the frame.

21 Claims, 6 Drawing Sheets

(56) References Cited

U.S. PATENT DOCUMENTS

| | | | | |
|---|---|---|---|---|
| 7,014,160 | B2 * | 3/2006 | Muyskens | B65D 5/5035 206/320 |
| 7,624,962 | B2 | 12/2009 | Muyskens | |
| 8,074,952 | B2 * | 12/2011 | Baechle | D06F 39/001 108/51.3 |
| 8,505,719 | B2 * | 8/2013 | Rodriguez Sanchez | B65D 85/68 206/320 |
| 9,540,158 | B1 * | 1/2017 | Fox | B65D 67/00 |
| 9,670,611 | B2 * | 6/2017 | Senn | B65D 5/02 |
| 9,731,861 | B2 * | 8/2017 | Cram | B65D 19/44 |
| 9,790,634 | B2 * | 10/2017 | Senn | B65D 5/02 |
| 10,309,051 | B2 * | 6/2019 | Lentz | D06F 58/20 |
| 2005/0269476 | A1 * | 12/2005 | Muyskens | B65D 5/5035 248/346.03 |
| 2011/0232230 | A1 * | 9/2011 | Rodriguez Sanchez | B65D 85/68 53/203 |
| 2011/0253869 | A1 * | 10/2011 | Baechle | D06F 39/001 248/346.03 |
| 2017/0145622 | A1 * | 5/2017 | Lentz | D06F 58/20 |
| 2017/0197753 | A1 * | 7/2017 | Cram | B65D 19/44 |

FOREIGN PATENT DOCUMENTS

| | | |
|---|---|---|
| CN | 203806421 | 9/2014 |
| JP | H0872876 | 3/1996 |
| JP | H09132288 | 5/1997 |
| JP | H09207987 | 8/1997 |

* cited by examiner

METHOD FOR FORMING A SHIPPING SUPPORT FOR A WASHING MACHINE APPLIANCE

FIELD OF THE INVENTION

The present subject matter relates generally to shipping supports for washing machine appliances.

BACKGROUND OF THE INVENTION

Washing machine appliances generally include an apron or cabinet. A tub that contains wash fluid during operation of the washing machine appliance is mounted within the cabinet. A basket within the tub holds articles for washing and is rotatable within the tub while washing the articles. To reduce noisy vibrations when the basket spins within the tub, the tub is suspended on the cabinet such that the tub is movable relative to the cabinet. However, movement of the tub relative to the cabinet can be problematic while shipping the washing machine appliance.

After manufacture, the washing machine appliance is generally packaged within a shipping box. The shipping box can limit damage to the washing machine appliance during transit. However, known shipping boxes suffer various drawbacks. For example, known packaging for washing machine appliances can allow bending of the cabinet when one shipping box is "snugged" or pushed against another shipping box. As another example, known packaging for washing machine appliances can allow bending of the cabinet when a clamp is used to lift the shipping box.

BRIEF DESCRIPTION OF THE INVENTION

Aspects and advantages of the invention will be set forth in part in the following description, or may be apparent from the description, or may be learned through practice of the invention.

In an example embodiment, a method for forming a shipping support for a washing machine appliance includes attaching an elongated post to a corrugated sheet. The method also includes attaching the corrugated sheet to a frame. The frame has a truncated pyramid base at a center of the frame. The truncated pyramid base may be formed with a plurality of supports attached to a plurality of flaps of the frame.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
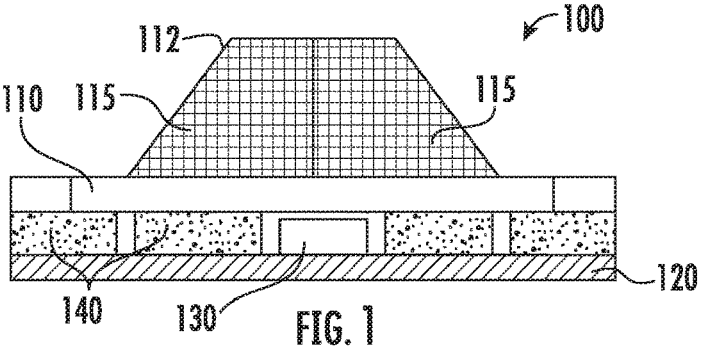
FIG. 1 is a front, elevation view of a shipping support for a washing machine appliance according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
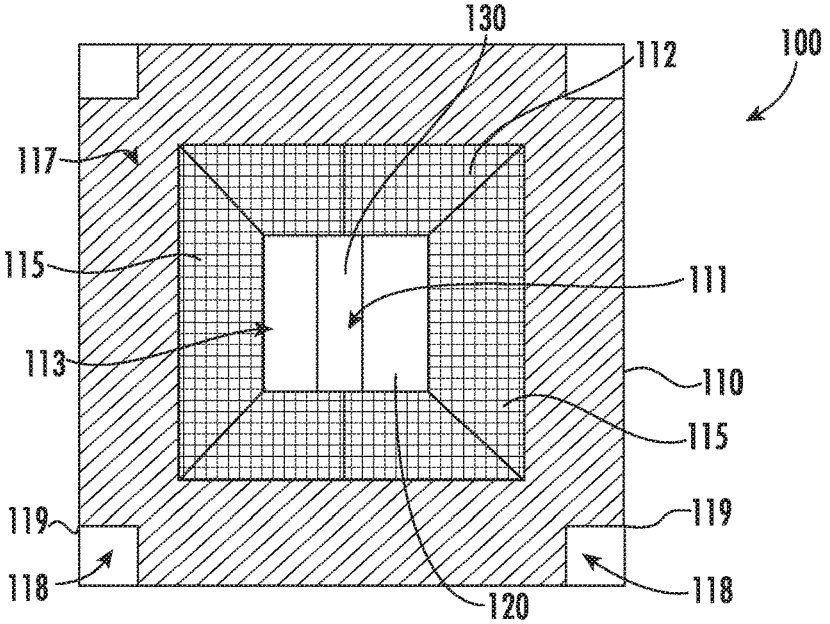
FIG. 2 is a top, plan view of the example shipping support of FIG. 1.

FIG. 1 is a front, elevation view of a shipping support 100 for a washing machine appliance according to an example embodiment of the present subject matter. FIG. 2 is a top, plan view of shipping support 100. FIGS. 3 through 8 illustrate shipping support 100 in various stages of assembly. As discussed in greater detail below, shipping support 100 may be used in packaging for a vertical axis washing machine appliance to reduce damage to the vertical axis washing machine appliance during transit. Shipping support 100 may be used in or with any suitable vertical axis washing machine appliance. For example, shipping support 100 may be used in or with the washing machine appliance described in U.S. Pat. No. 9,598,809 of Davis, which is incorporated by reference in its entirety for all purposes.

With reference to FIGS. 1 and 2, shipping support 100 includes a frame 110 with a truncated pyramid base 112, a corrugated sheet 120, an elongated post 130 and a plurality of spacer blocks 140. Shipping support 100 and a method of forming shipping support 100 is described in greater detail below in the context of FIGS. 3 through 8. It will be understood that the various steps shown in FIGS. 3 through 8 may be performed in any suitable order. Thus, it will be understood that the particular order shown in FIGS. 3 through 8 is provided by way of example only.

Figure 3:
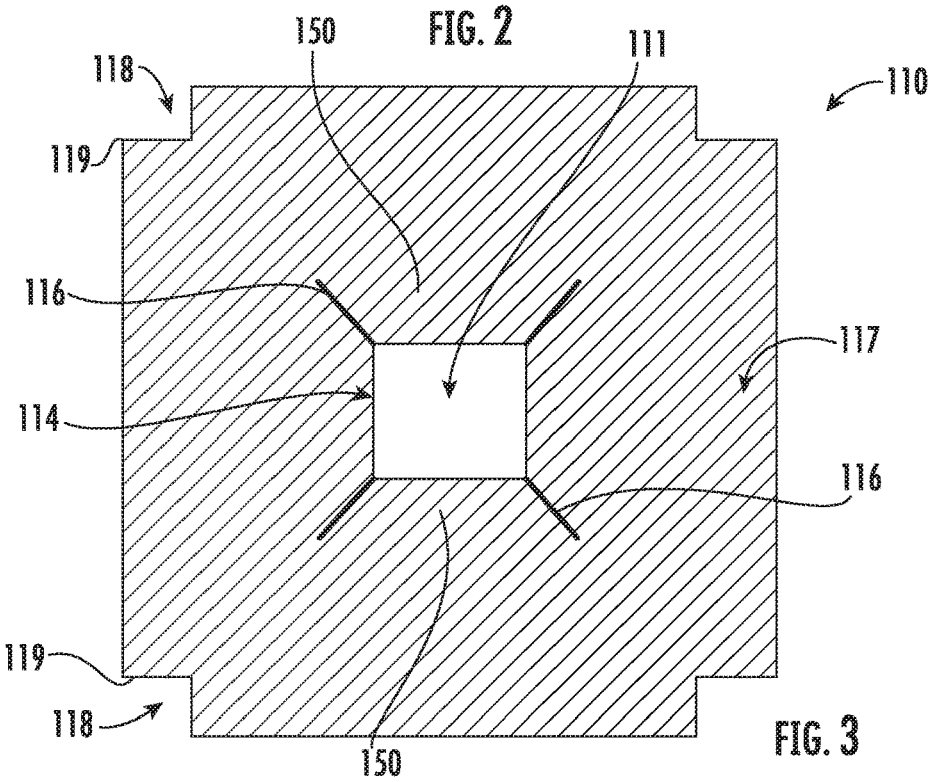
FIGS. 3 through 8 illustrate the example shipping support of FIG. 1 in various stages of assembly.
Figure 5:
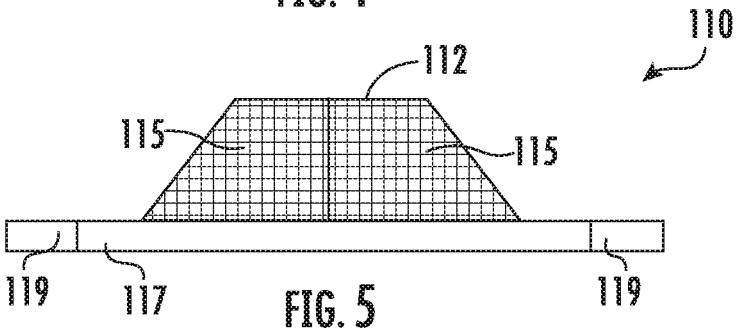

In FIGS. 3 and 5, the formation of frame 110 with truncated pyramid base 112 is shown. To form frame 110, a fiberboard blank may be cut or formed into the shape shown in FIG. 3. Thus, e.g., frame 110 may be cut into a generally square shape. However, corners 118 of frame 110 may be notched, as shown in FIG. 3. Thus, e.g., the outer edge of frame 110 may be generally square while also incorporating notches 119 at the corners 118 of frame 110. A square shaped cutout 114 may also be made at a center 111 of frame 110. From the square shaped cutout 114 at center 111, cut lines 116 may be made to form a plurality of flaps 150, e.g., four flaps. Cut lines 116 may be cut such that each flap 150 has an isosceles trapezoid shape.

Figure 4:
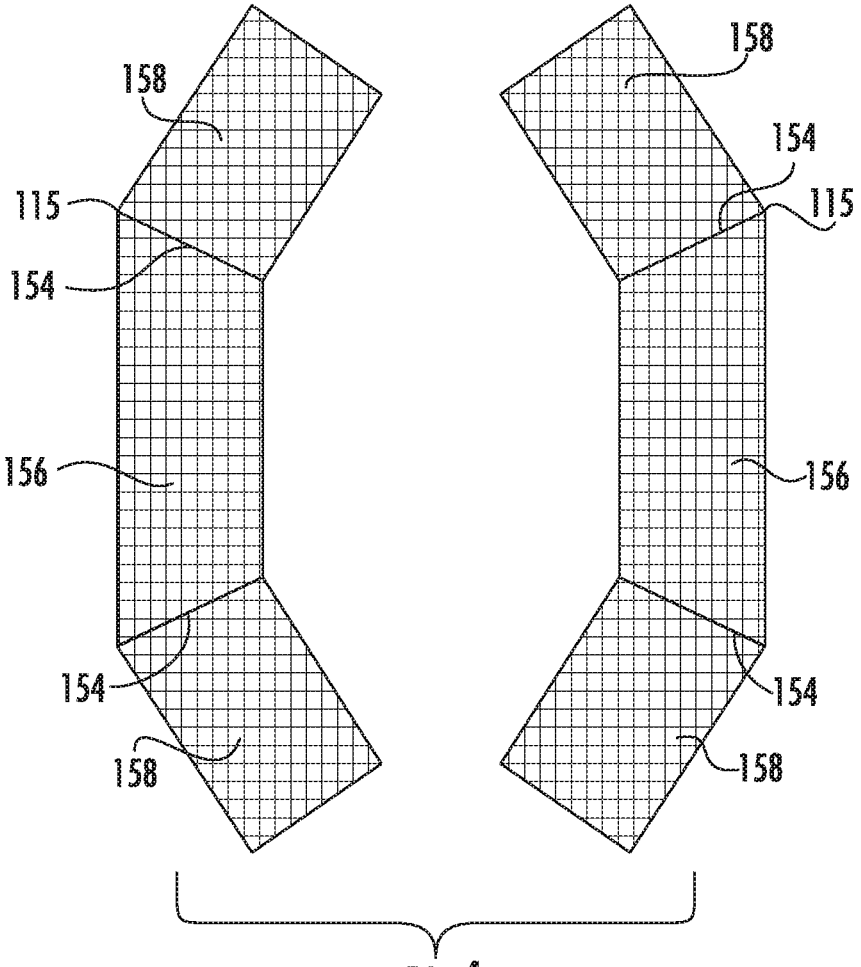

Flaps 150 may bend relative to the rest of frame 110 in order to form truncated pyramid base 112. In particular, turning to FIG. 4, a plurality of supports 115 (e.g., two supports 115) may be mounted to flaps 150 in order to form truncated pyramid base 112. Flaps 150 may also have score or fold lines 154 such that flaps 150 collectively have a truncated pyramid shape when bent along fold lines 154. Turning to FIG. 5, flaps 150 may all be bent relative to a planar portion 117 of frame 110, and supports 115 may then be attached to flaps 150 to form truncated pyramid base 112. For example, supports 115 may be adhered and/or stapled to flaps 150 such that supports 115 and flaps 150 support one another and form truncated pyramid base 112. Thus, e.g., each support 115 may have fold lines 154 that form one isosceles trapezoid portion 156 and two right trapezoid portions 158 with the isosceles trapezoid portion 156 positioned between the two right trapezoid portion 158 as shown in FIG. 4. In such a manner, frame 110 may be formed with truncated pyramid base 112.

When truncated pyramid base 112 is formed on frame 110, truncated pyramid base 112 may extend away from planar portion 117 of frame 110. As an example, truncated pyramid base 112 may extend upwardly from planar portion 117 of frame 110, as shown in FIG. 5. In addition, truncated base 112 may be hollow, as shown in FIG. 2. Multiple frames 110 with truncated pyramid bases 112 may be stacked on top of one another prior to being subsequently incorporated into shipping support 100. Thus, e.g., frame 110 with truncated pyramid base 112 may be formed at one location and then easily transported to another location where frame 110 is assembled into shipping support 100.

Figure 6:
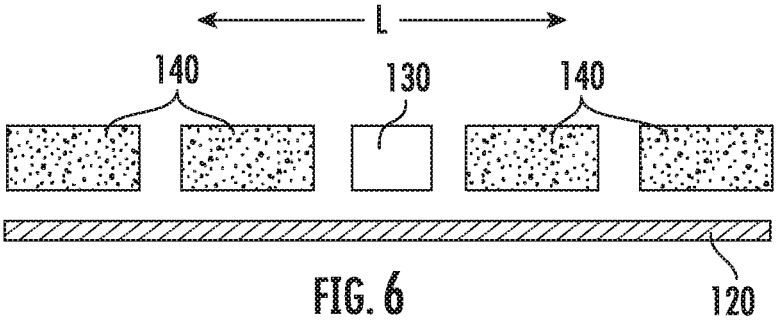
Figure 7:
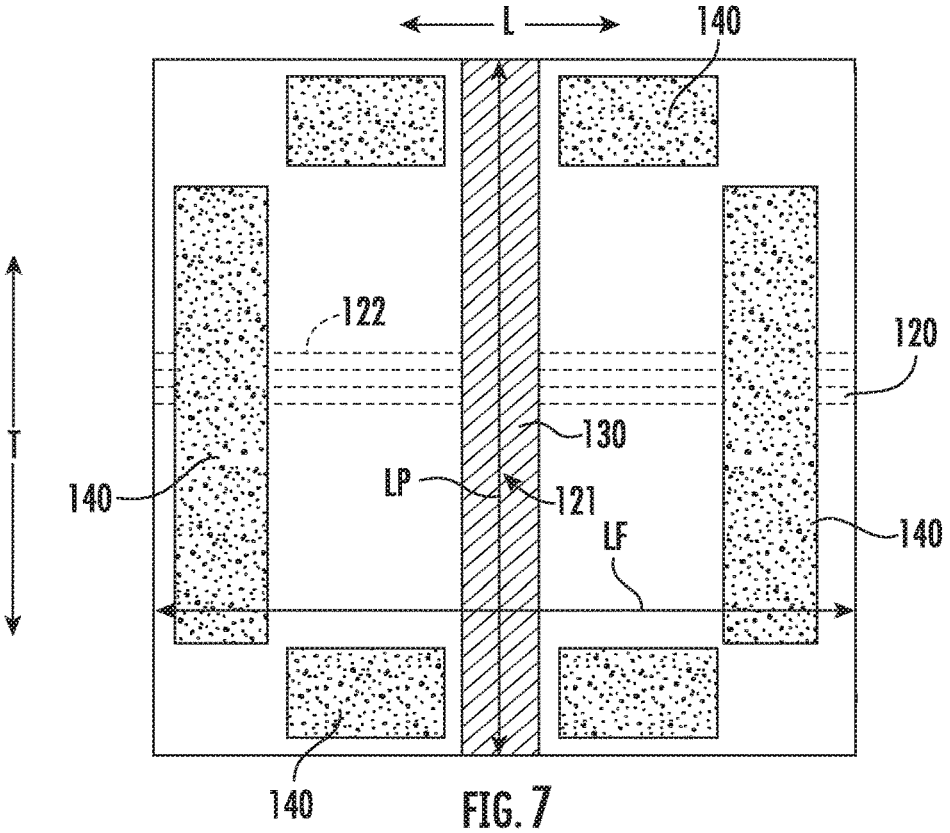
Figure 8:
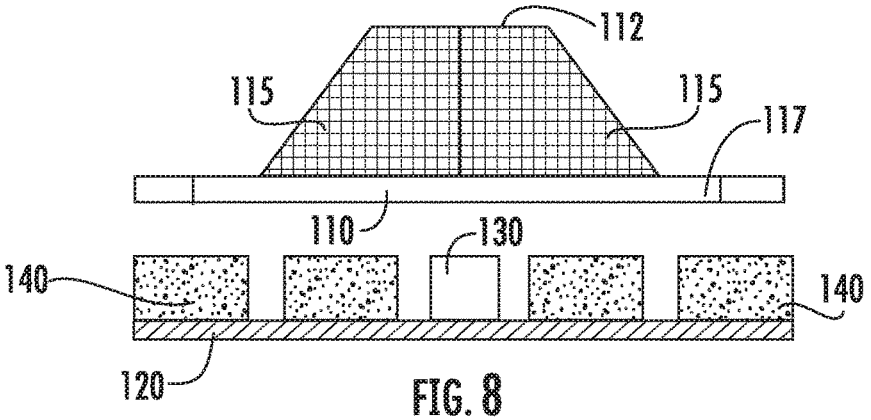

Turning to FIGS. 6 and 7, formation of corrugated sheet 120 with elongated post 130 and spacer blocks 140 is shown. To form corrugated sheet 120, a fiberboard blank may be cut or formed into the shape shown in FIG. 7. Thus, e.g., frame 110 may be cut into a generally square shape.

Corrugated sheet 120 has flutes 122 (only a portion of the flutes within corrugated sheet 120 are shown with dashed lines in FIG. 7) that extend longitudinally within corrugated sheet 120. For example, corrugated sheet 120 may be formed from a fluted corrugated board and one or two flat linerboards, and the fluted corrugated board may define flutes 122 within corrugated sheet 120. In certain example embodiments, the corrugated sheet 120 may be a double (or more) walled corrugated board. Corrugated fiberboard is well understood by those skilled in the art and is not described in detail herein.

As shown in FIGS. 6 and 7, elongated post 130 and spacer blocks 140 are attached to corrugated sheet 120. For example, elongated post 130 and spacer blocks 140 may be adhered and/or stapled to corrugated sheet 120. Elongated post 130 may be oriented perpendicular to flutes 122 within corrugated sheet 120 when elongated post 130 is attached to corrugated sheet 120. For example, flutes 122 within corrugated sheet 120 may extend longitudinally along a lateral direction L, and elongated post 130 may extend longitudinally along a transverse direction T that is perpendicular to the lateral direction L. Elongated post 130 may also be positioned at a center 121 of corrugated sheet 120. Spacer blocks 140 may be distributed along the outer edge of corrugated sheet 120.

A length LP of elongated post 130, e.g., along the transverse direction T may be about equal to a length LF of flutes 122, e.g., along the lateral direction L. As used herein, the term "about" means within ten percent of the stated length when used in the context of lengths. A thickness of elongated post 130 may be less than a thickness of spacer blocks 140, e.g., where the thicknesses are defined perpendicular to the lateral direction L and the transverse direction T. For example, the thickness of elongated post 130 may at least about an eighth inch (⅛") or about a quarter inch (¼") less than the thickness of spacer blocks 140. As used herein, the term "about" means within ten percent of the stated thickness when used in the context of thicknesses.

Turning back to FIGS. 1 and 2, corrugated sheet 120 with elongated post 130 and spacer blocks 140 may then be attached to frame 110 with truncated pyramid base 112. For example, corrugated sheet 120 with elongated post 130 and spacer blocks 140 may be adhered and/or stapled to frame 110 with truncated pyramid base 112. As a particular example, elongated post 130 and spacer blocks 140 may be adhered and/or stapled to planar portion 117 of frame 110. Thus, e.g., elongated post 130 and spacer blocks 140 may be positioned between truncated pyramid base 112 and corrugated sheet 120.

As may be seen from the above, support assembly 100 may be assembled from frame 110 with truncated pyramid base 112 and corrugated sheet 120 with elongated post 130 and spacer blocks 140. Thus, it will be understood that corrugated sheet 120 with elongated post 130 and spacer blocks 140 may be formed or assembled separately from frame 110 with truncated pyramid base 112 and then assembled together to form support assembly 100.

It will be understood that the term "attaching" is used broadly herein. Thus, the term "attaching" may cover both direct and indirect mechanical coupling. Accordingly, the various components of support assembly 100 may be attached together directly or indirectly to form support assembly 100 in any suitable order. As a particular example, corrugated sheet 120 may be attached to frame 110 by stapling planar portion 117 of frame 110 to elongated post 130 when elongated post 130 is adhered and/or stapled to corrugated sheet 120. The various components of support assembly 100 may similarly be attached to one another to form support assembly 100.

The various components of shipping support 100 may be formed from a suitable material. For example, frame 110 may be formed of corrugated fiberboard. As another example, frame 110 may be formed of thermoformed plastic. Elongated post 130 may be formed of wood, metal, plastic, etc. Corrugated sheet 120 may be corrugated fiberboard. Spacer blocks 140 may be fiberboard, wood, foam plastic, such as expanded polystyrene, etc. The above described materials for the various components of shipping support 100 may assist with protecting a vertical axis washing machine appliance during shipping.

Once shipping support 100 is assembled, truncated pyramid base 112 of shipping support 100 may be extend into a cabinet of the vertical axis washing machine appliance. In particular, truncated pyramid base 112 may be inserted into the cabinet until a motor on a tub of the washing machine appliance is received within an opening 113 at a top of truncated pyramid base 112. During transit, the motor may impact against the sides of truncated pyramid base 112 to limit the motion of the tub within the cabinet and, e.g., thereby prevent the tub from impacting against the cabinet and denting the cabinet. Thus, truncated pyramid base 112 may assist with limiting motion of the tub within the cabinet while the washing machine appliance is being transported. In addition, truncated pyramid base 112 may also assist with transferring the force of the tub downwardly when the vertical axis washing machine appliance is dropped during transit, e.g., thereby reducing the force of the tub that transfers through the cabinet during such drops.

Elongated post 130 also protects the cabinet from damage during shipping of the washing machine appliance. For example, the length LP of elongated post 130 may be greater than a width of the cabinet, e.g., front to back, and about equal to an interior width of a shipping box. Thus, when the washing machine appliance and support assembly 100 are within the shipping box and the shipping box slides into another shipping box, elongated post 130 transfers the force of such collision though elongated post 130 across support assembly 100, and thereby avoids damage, such as denting, of the cabinet.

The orientation of flutes 122 within corrugated sheet 120 may also assist with protecting the cabinet of a washing machine appliance from damage during shipping of the washing machine appliance. For example, flutes 122 within corrugated sheet 120 may be oriented parallel to a clamping direction for lifting a shipping box. In addition, the length LF of flutes 122 may be greater than a width of the cabinet, e.g., side to side, and about equal to an interior width of a shipping box. Thus, when the washing machine appliance and support assembly 100 are within the shipping box and the shipping box is gripped by a clamp, corrugated sheet 120 may transfer the clamping force though corrugated sheet 120 across support assembly 100, and thereby avoid damage, such as denting, of the cabinet.

Notches 119 at the corners 118 of frame 110 may also be sized and positioned to receive leveling legs of a washing machine appliance. Thus, e.g., the leveling legs may rest within notches 119 such that a bottom of the cabinet rests on planar portion 117 of frame 110 when the washing machine appliance and support assembly 100 are within a shipping box. If the shipping box is dropped on an edge of the box or impacted on a side of the box, denting of the cabinet may be prevented by support assembly 100.

Figure 9:
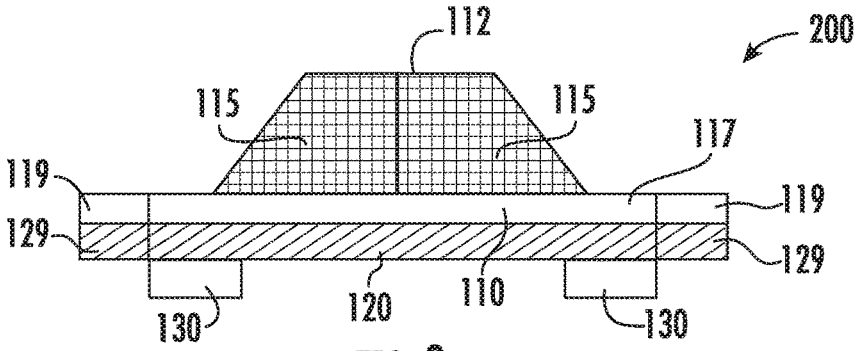
FIG. 9 is a front, elevation view of a shipping support for a washing machine appliance according to a second example embodiment of the present subject matter.
Figure 10:
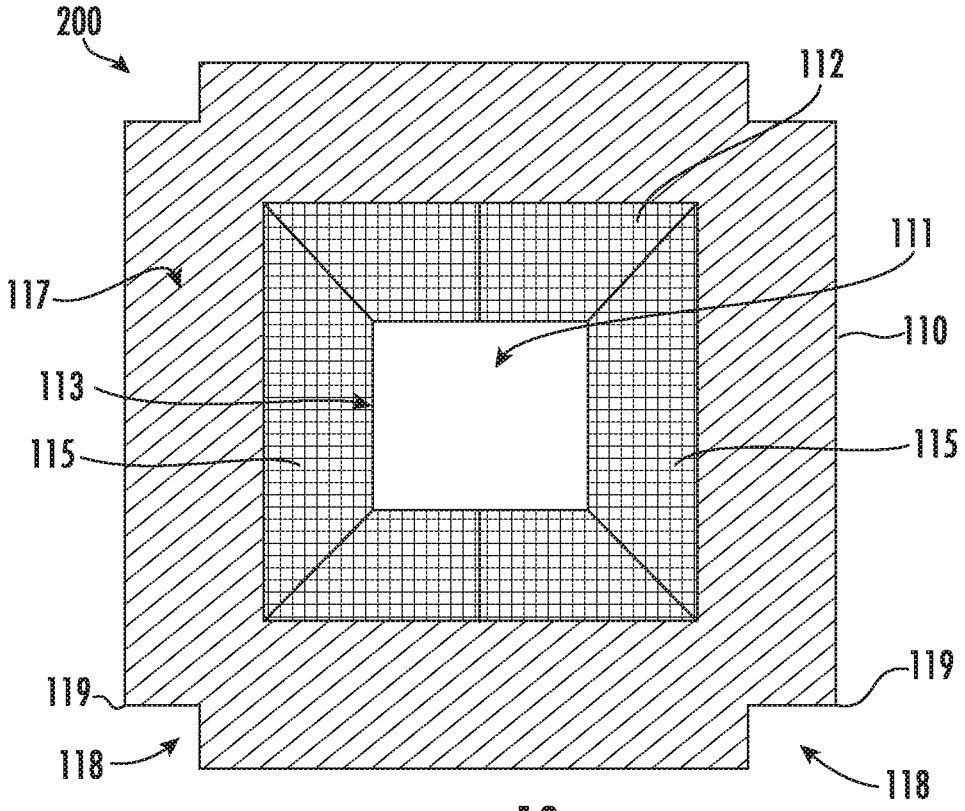
FIG. 10 is a top, plan view of the example shipping support of FIG. 9.
Figure 11:
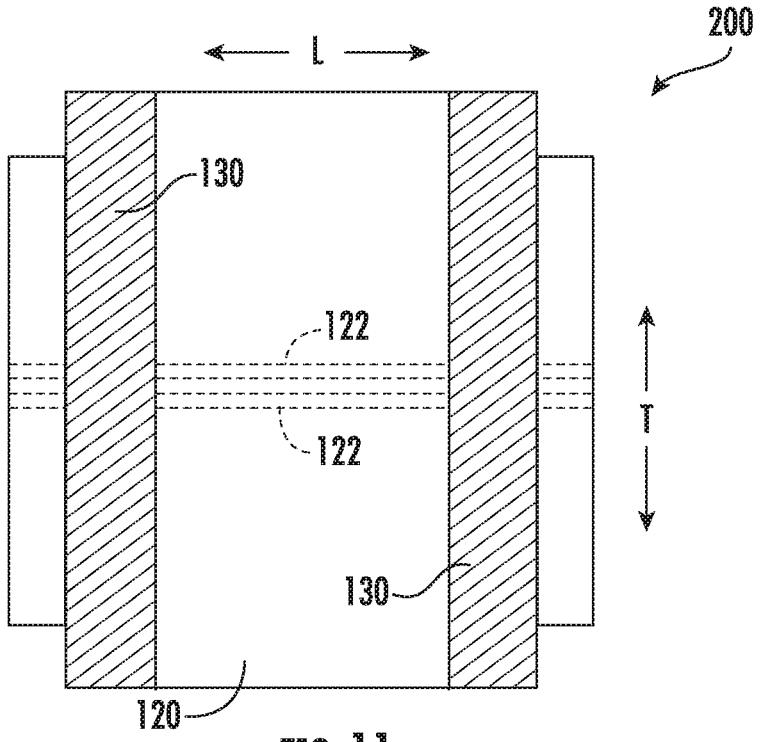
FIG. 11 is a bottom, plan view of the example shipping support of FIG. 9.

FIG. 9 is a front, elevation view of a shipping support 200 for a washing machine appliance according to a second example embodiment of the present subject matter. FIG. 10 is a top, plan view of shipping support 200. FIG. 11 is a bottom, plan view of shipping support 200. Shipping support 200 includes the same or similar features as shipping support 100 and may be constructed in the same or similar manner except as noted.

As shown in FIGS. 9 through 11, support assembly 200 includes a pair of elongated posts 130. Elongated posts 130 are attached to corrugated sheet 120 at opposite sides of corrugated sheet 120, e.g., along the lateral direction L. Both of elongated posts 130 are oriented perpendicular to flutes 122 within corrugated sheet 120. In addition, corrugated sheet 120 may be adhered and/or stapled to planar portion 117 of frame 110. Thus, e.g., corrugated sheet 120 may be positioned between truncated pyramid base 112 and elongated posts 130. Support assembly 200 does not include spacer blocks 130.

Corners of corrugated sheet 120 may be notched, as shown in FIG. 9. Thus, e.g., the outer edge of corrugated sheet 120 may be generally square while also incorporating notches 129 at the corners of corrugated sheet 120. The shape of corrugated sheet 120 may generally correspond to the shape of frame 110 prior to formation of truncated pyramid base 112. Thus, corrugated sheet 120 may have a common size and/or shape as frame 110, e.g., except for square shaped cutout 114 and/or fold lines 154. Notches 119 at the corners 118 of frame 110 and/or notches 129 at the corners of corrugated sheet 120 may be sized and positioned to receive leveling legs of a washing machine appliance. As an example, each notch 119 may be aligned with a respective notch 129 to facilitate receipt of the leveling legs.

Figure 12:
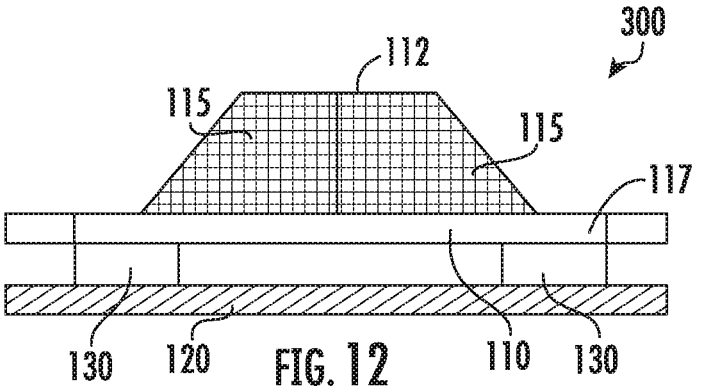
FIG. 12 is a front, elevation view of a shipping support for a washing machine appliance according to a third example embodiment of the present subject matter.

FIG. 12 is a front, elevation view of a shipping support 300 for a washing machine appliance according to a third example embodiment of the present subject matter. Shipping support 300 includes the same or similar features as shipping supports 100, 200 and may be constructed in the same or similar manner except as noted.

As shown in FIG. 12, the position of corrugated sheet 120 and elongated posts 130 is flipped in support assembly 300 relative to support assembly 200. In particular, elongated posts 130 may be adhered and/or stapled to planar portion 117 of frame 110. Thus, e.g., elongated posts 130 may be positioned between truncated pyramid base 112 and corrugated sheet 120. Support assembly 300 does not include spacer blocks 130.

Figure 13:
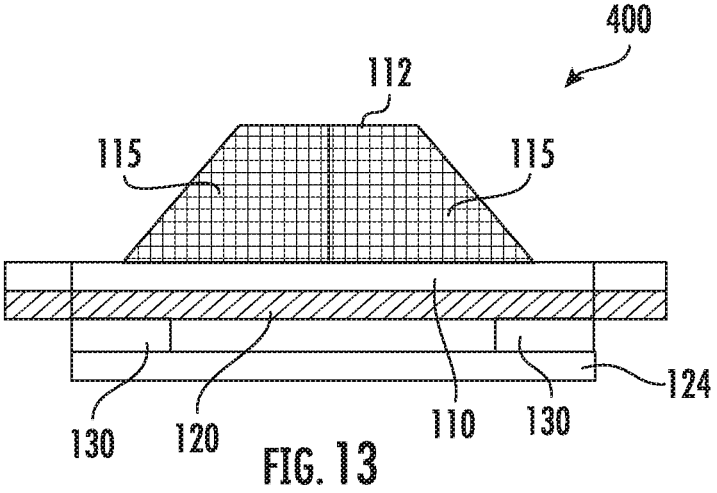
FIG. 13 is a front, elevation view of a shipping support for a washing machine appliance according to a fourth example embodiment of the present subject matter.

FIG. 13 is a front, elevation view of a shipping support 400 for a washing machine appliance according to a fourth example embodiment of the present subject matter. Shipping support 400 includes the same or similar features as shipping supports 100, 200 and may be constructed in the same or similar manner except as noted.

As shown in FIG. 13, support assembly 400 has the same construction as support assembly 200; however, shipping support 400 includes an additional corrugated sheet 124. Elongated posts 130 may be oriented perpendicular to the flutes within additional corrugated sheet 124 when elongated posts 130 are attached to additional corrugated sheet 124, e.g., in the manner described above for corrugated sheet 120. Elongated posts 130 may also be positioned between corrugated sheet 120 and additional corrugated sheet 124 when elongated posts 130 are attached to corrugated sheet 120 and additional corrugated sheet 124. Additional corrugated sheet 124 may be useful when support assembly 400 is on rollers to avoid elongated posts 130 snagging between rollers, e.g., on a turn.

Figure 14:
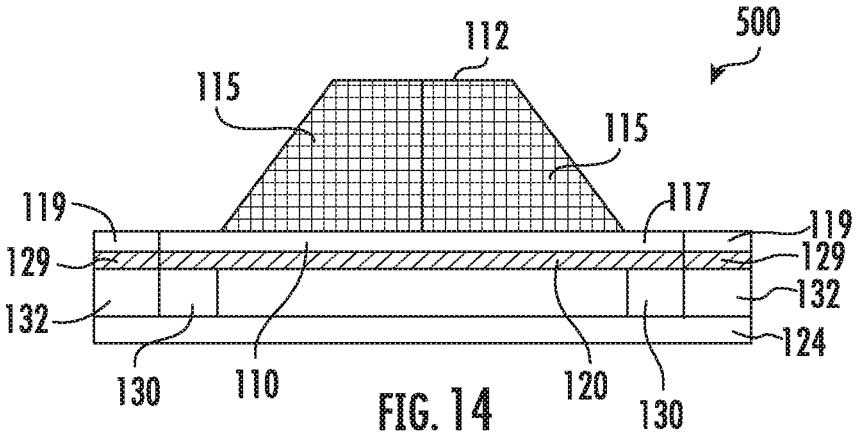
FIG. 14 is a front, elevation view of a shipping support for a washing machine appliance according to a fifth example embodiment of the present subject matter.

FIG. 14 is a front, elevation view of a shipping support 500 for a washing machine appliance according to a fifth example embodiment of the present subject matter. Shipping support 500 includes the same or similar features as shipping supports 100, 200, 400 and may be constructed in the same or similar manner except as noted.

As shown in FIG. 14, support assembly 500 has the same construction as support assembly 400; however, elongated posts 130 are positioned at opposite outer edges of corrugated sheet 120 and additional corrugated sheet 124. Thus, elongated posts 130 have notches 132. Each notch 132 is aligned a respective one of notches 119 and/or notches 129. Thus, notches 132 may receive leveling legs of a washing machine appliance, in the manner described above for notches 119.

Figure 15:
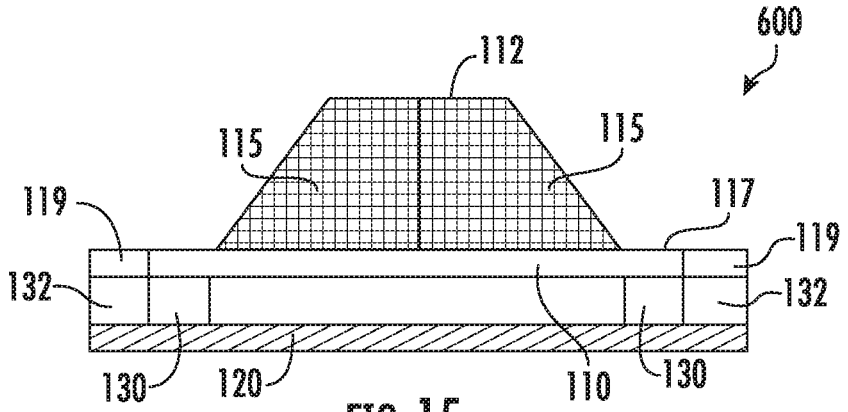
FIG. 15 is a front, elevation view of a shipping support for a washing machine appliance according to a sixth example embodiment of the present subject matter.
Figure 16:
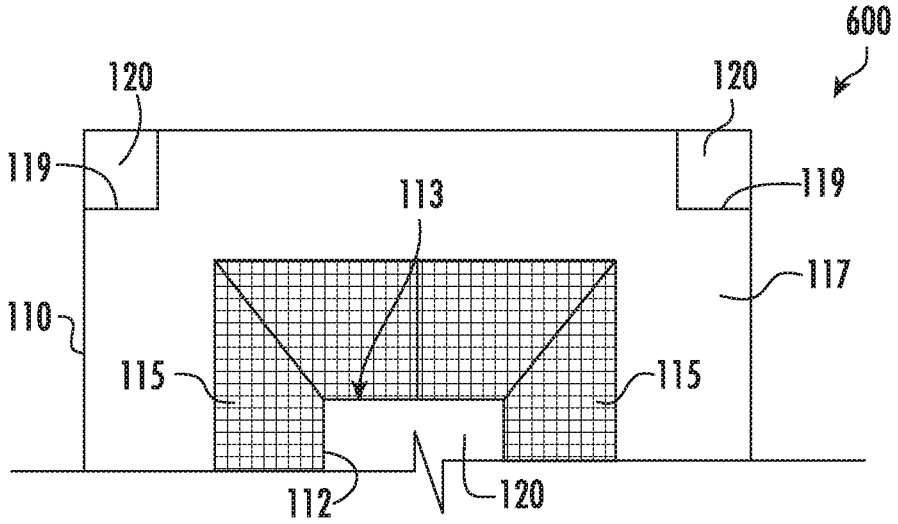
FIG. 16 is a partial top, plan view of the example shipping support of FIG. 15.

FIG. 15 is a front, elevation view of a shipping support 600 for a washing machine appliance according to a sixth example embodiment of the present subject matter. FIG. 16 is a partial top, plan view of shipping support 600. Shipping support 600 includes the same or similar features as shipping supports 100, 300 and may be constructed in the same or similar manner except as noted.

As shown in FIG. 15, support assembly 600 has the same construction as support assembly 300; however, elongated posts 130 are positioned at opposite outer edges of corrugated sheet 120. Thus, elongated posts 130 have notches 132. Each notch 132 is aligned a respective one of notches 119. Thus, notches 132 may receive leveling legs of a washing machine appliance, in the manner described above for notches 119.

Figure 17:
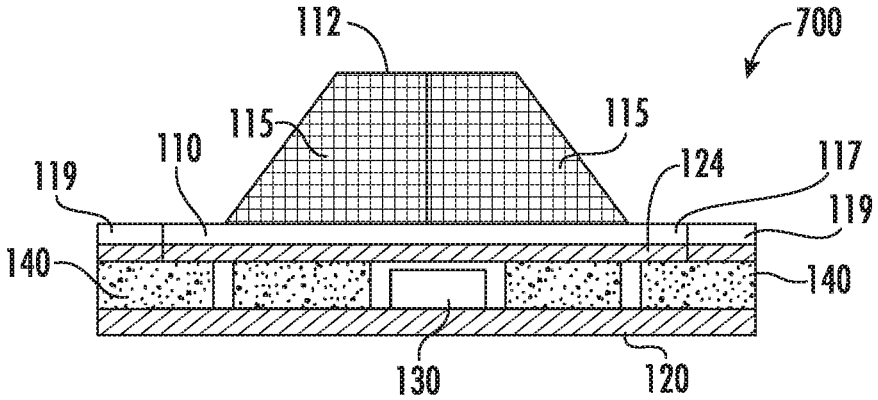
FIG. 17 is a front, elevation view of a shipping support for a washing machine appliance according to a seventh example embodiment of the present subject matter.

FIG. 17 is a front, elevation view of a shipping support 700 for a washing machine appliance according to a seventh example embodiment of the present subject matter. Shipping support 600 includes the same or similar features as shipping supports 100 and may be constructed in the same or similar manner except as noted.

As shown in FIG. 17, support assembly 700 has the same construction as support assembly 100; however, shipping support 700 includes an additional corrugated sheet 124. Additional corrugated sheet 124 is attached to planar portion 117 of frame 110, elongated post 130 and spacer blocks 140. Thus, additional corrugated sheet 124 may be positioned between frame 110 and elongated post 130/spacer blocks 140. Additional corrugated sheet 124 may be notched in the manner described above for shipping support 600.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for forming a shipping support for a washing machine appliance, comprising:

attaching an elongated post to a corrugated sheet; and attaching the corrugated sheet to a frame, the frame having a truncated pyramid base at a center of the frame, the truncated pyramid base formed with a plurality of supports attached to a plurality of flaps of the frame.

2. The method of claim 1, wherein the corrugated sheet has a width along a lateral direction, the elongated post has a length along a transverse direction that is perpendicular to the lateral direction, and the width of the corrugated sheet is about equal to the length of the elongated post.

3. The method of claim 1, wherein the elongated post is oriented perpendicular to flutes of the corrugated sheet when the elongated post is attached to the corrugated sheet.

4. The method of claim 3, wherein the flutes of the corrugated sheet extend longitudinally along a lateral direction when the elongated post is attached to the corrugated sheet, and the elongated post extends longitudinally along a transverse direction that is perpendicular to the lateral direction when the elongated post is attached to the corrugated sheet.

5. The method of claim 3, further comprising attaching an additional corrugated sheet to the elongated post, the elongated post positioned between the corrugated sheet and the additional corrugated sheet when the elongated post is attached to the corrugated sheet and the additional corrugated sheet.

6. The method of claim 1, wherein the elongated post is a plurality of elongated posts, each of the plurality of elongated posts attached to the corrugated sheet.

7. The method of claim 6, wherein the corrugated sheet is positioned between the frame and the plurality of elongated posts when the corrugated sheet is attached to the frame.

8. The method of claim 6, wherein each of the plurality of elongated posts defines a pair of notches, and each of the pair of notches is sized and positioned for receiving a respective leveling leg of the washing machine appliance.

9. The method of claim 6, further comprising attaching an additional corrugated sheet to the plurality of elongated posts, the plurality of elongated posts positioned between the corrugated sheet and the additional corrugated sheet when the plurality of elongated posts is attached to the corrugated sheet and the additional corrugated sheet.

10. The method of claim 1, wherein the elongated post is a wood elongated post.

11. The method of claim 1, wherein attaching the elongated post to the corrugated sheet further comprises attaching a plurality of spacer blocks to the corrugated sheet or the frame.

12. The method of claim 11, wherein attaching the elongated post and the plurality of spacer blocks to the corrugated sheet or the frame comprises stapling, adhering or both stapling and adhering the elongated post and the plurality of spacer blocks to the corrugated sheet or the frame.

13. The method of claim 11, wherein the plurality of spacer blocks are foam spacer blocks.

14. The method of claim 1, wherein attaching the elongated post to the corrugated sheet comprises stapling, adhering or both stapling and adhering the elongated post to the corrugated sheet.

15. The method of claim 1, wherein attaching the corrugated sheet to the frame comprises stapling, adhering or both stapling and adhering the corrugated sheet or the elongated post to the frame.

16. The method of claim 1, wherein the frame is a corrugated fiberboard frame, and the corrugated sheet is a corrugated fiberboard sheet.

17. The method of claim 1, wherein the truncated pyramid base is hollow.

18. The method of claim 1, wherein the corrugated sheet has a plurality of notches, each notch of the plurality of notches is positioned at a respective corner of the corrugated sheet, and each of the plurality of notches is sized and positioned for receiving a respective leveling leg of the washing machine appliance.

19. The method of claim 1, wherein the frame has a plurality of notches, each notch of the plurality of notches is positioned at a respective corner of the frame, and each of the plurality of notches is sized and positioned for receiving a respective leveling leg of the washing machine appliance.

20. The method of claim 1, wherein the elongated post is positioned between the corrugated sheet and the frame when the corrugated sheet is attached to the frame.

21. The method of claim 1, wherein the elongated post is attached to a center the corrugated sheet.

* * * * *